the insulating layer furthest removed from the conducting member having its first surface in contact with the second surface of the next adjacent insulating layer;

portions of the first surface of said first one of said insulating layers being positioned across said openings and constituting the surface areas for receiving said stored charge patterns;

all of said layers being arranged to overlie portions of said conducting member planar surface while the remaining portions of said conducting member planar surface are exposed to said electron beam;

at least one of said insulating layers being formed of an insulating material whose conductivity is unaffected by the presence of ionizing radiation to aid in preventing the transfer of charge stored on the stored charge surface to significantly increase image retention time;

at least said one layer in contact with the conducting member forming pedestals for insulating its associated charge storage surface from said conducting member;

said pedestals having cross-sections smaller than their charge storage surfaces whereby the pedestals prevent the transfer of charge from the charge storage surface to said conducting member.

7. An electronic storage tube having a target structure including first means substantially unaffected by ionizing radiation which is present during operation of the tube for significantly improving the image retention time of the target structure wherein said tube comprises:

second means including means for generating an electron beam for applying a signal to the target structure to establish a desired stored charge distribution on the target structure representative of the image to be stored;

third means for detecting the stored charge distribution established on the target structure and wherein said first means comprises a pattern of conducting and insulating areas, said conducting areas being electrically connected to each other to form a conducting member having at least one planar surface;

said insulating areas being formed of first and second layers of insulating materials placed upon a first planar surface of said conducting member;

each of said layers having first and second planar surfaces, the first planar surface of a first one of said layers being in contact with the planar surface of the conducting member and the second planar surface of said one of said layers being in contact with the first planar surface of the second one of said layers;

the second planar surface of the second insulating layer which is furthest removed from said conducting member constituting the surface for storing the charge pattern;

said layers being arranged to overlie portions of said conducting member planar surface while the remaining portions of said conducting member planar surface are exposed to said electron beam;

the insulating layer furthest removed from said conducting member being silicon dioxide;

the layer in contact with the conducting member forming pedestals for insulating said stored charge surface from said conducting member;

said pedestals having cross-sections smaller than said stored charge surfaces whereby the pedestals aid in preventing the transfer of charge from the stored charge surface to said conducting member, and said pedestals being formed from an insulating material chosen from the group of materials including silicon nitride, aluminum oxide and silicon oxynitride, which materials have a conductivity which is substantially unaffected by the presence of ionizing radiation to still further prevent the transfer of charge stored on the stored charge surface thereby significantly increasing image retention time.

8. An electron storage tube having a target structure including first means substantially unaffected by ionizing radiation which is present during operation of the tube for significantly improving the image retention time of the target structure wherein said tube comprises:

second means including means for generating an electron beam for applying a signal to the target structure to establish a desired stored charge distribution on the target structure representative of the image to be stored;

third means for detecting the stored charge distribution established on the target structure and wherein said first means comprises a pattern of conducting and insulating areas, said conducting areas being electrically connected to each other to form a conducting member having at least one planar surface;

said insulating areas being formed of first and second layers of insulating materials placed upon a first planar surface of said conducting member;

each of said layers having first and second planar surfaces, the first planar surface of a first one of said layers being in contact with the planar surface of the conducting member and the second planar surface of said one of said layers being in contact with the first planar surface of the second one of said layers;

the second planar surface of the second insulating layer which is furthest removed from said conducting member constituting the surface for storing the charge pattern;

said layers being arranged to overlie portions of said conducting member planar surface while the remaining portions of said conducting member planar surface are exposed to said electron beam;

the insulating layer furthest removed from said conducting member being formed of an insulating material whose conductivity is substantially unaffected by the presence of ionizing radiation to prevent the transfer of charge stored on the stored charge surface to significantly increase image retention time, the insulating material being chosen from the group of materials including silicon nitride, aluminum oxide and silicon oxy-nitride;

said one layer in contact with the conducting member forming pedestals for insulating its associated charge storage surface from said conducting member;

said pedestals being formed of silicon oxide and having cross-sections smaller than their stored charge surfaces whereby the pedestals further aid in preventing the transfer of charge from the stored charge surface to said conducting member.

* * * * *

United States Patent [19]

Picker

[11] 3,940,652

[45] Feb. 24, 1976

[54] JUNCTION TARGET MONOSCOPE

[75] Inventor: Amos Picker, Sharon, Mass.

[73] Assignee: Raytheon Company, Lexington, Mass.

[22] Filed: Jan. 10, 1974

[21] Appl. No.: 433,014

Related U.S. Application Data

[63] Continuation of Ser. No. 228,732, Feb. 23, 1972, abandoned, which is a continuation of Ser. No. 37,552, May 15, 1970, abandoned.

[52] U.S. Cl. ..... 313/401; 313/366; 313/410

[51] Int. Cl.[2] ..... H01J 31/16; H01J 29/45

[58] Field of Search ..... 313/401, 366

[56] References Cited

UNITED STATES PATENTS

| | | | |
|---|---|---|---|
| 2,287,415 | 6/1942 | Burnett | 313/401 |
| 3,126,610 | 3/1964 | Kabell et al. | 313/401 X |
| 3,289,024 | 11/1966 | Haan et al. | 313/366 |
| 3,419,746 | 12/1968 | Crowell et al. | 315/10 |
| 3,541,383 | 11/1970 | Pruett et al. | 315/10 |
| 3,579,012 | 5/1971 | Zwicker et al. | 313/367 |

*Primary Examiner*—Robert Segal
*Attorney, Agent, or Firm*—John R. Inge; Joseph D. Pannone; Milton D. Bartlett

[57] ABSTRACT

A signal display system having a visual display and a display signal generator in which a semiconductor junction target has a high conductivity P layer, a low conductivity N layer, and a surface layer of insulating material having holes in the shape of letters or other characters. The target semiconductor junction is reverse biased so that when an electron beam striking the target is scanned over the character apertures, it will produce carrier multiplication in the target and an output signal several orders of magnitude greater than a conventional monoscope. The same principle may be used for a camera pickup tube when beam electrons returning from a light sensitive target are multiplied on striking a reverse biased junction target.

4 Claims, 7 Drawing Figures

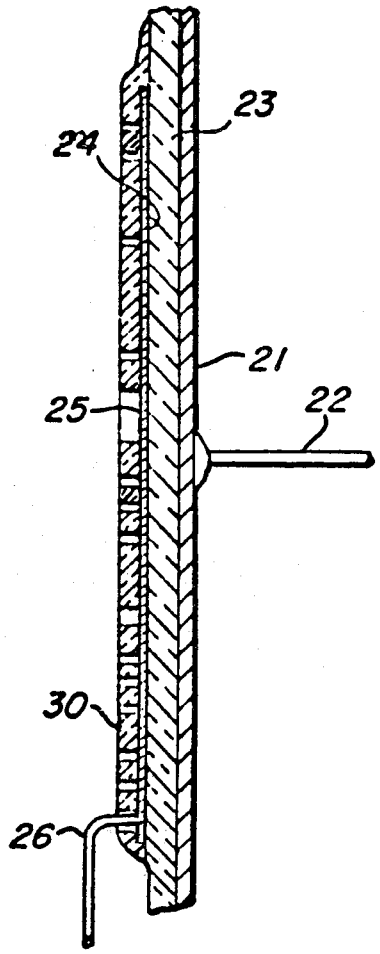

JUNCTION TARGET MONOSCOPE

CROSS REFERENCE TO RELATED APPLICATIONS

Figure 1:
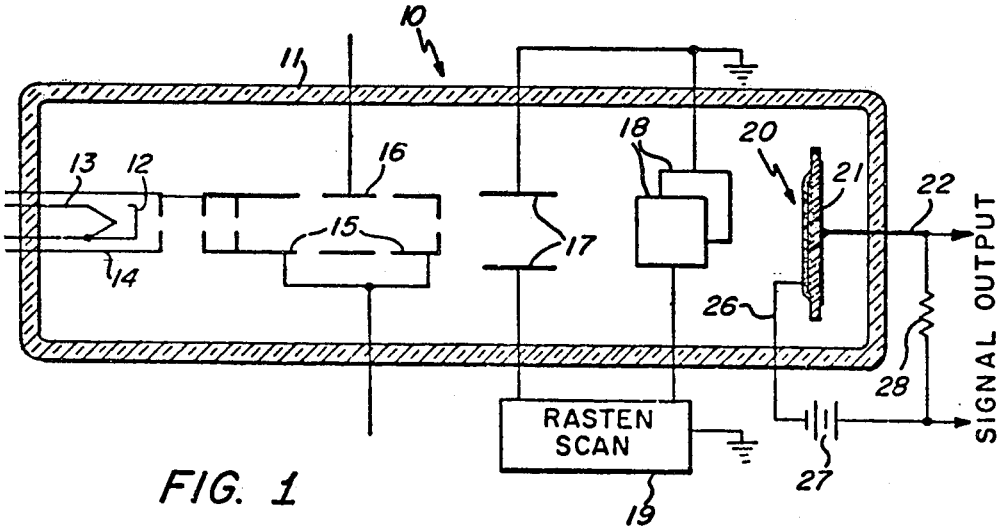

This is a continuation of application Ser. No. 228,732 filed Feb. 23, 1972 (now abandoned), which is a continuation of application Ser. No. 37,552 filed May 15, 1970 (not abandoned).

Application Ser. No. 19,190, filed Mar. 13, 1970 (now U.S. Pat. No. 3,697,955) by Joseph E. Bryden, entitled Visual Display System, and asssigned to the same assignee as this application, is hereby incorporated herein by reference.

BACKGROUND OF THE INVENTION

Conventional monoscopes display systems are well known and comprise a cathode ray tube driven by a monoscope wherein a target electrode of aluminum has a pattern of characters deposited thereon in the form of carbon, which has a different secondary emission characteristic from the aluminum base material.

Under constant use such a monoscope will deteriorate in quality within a few thousand hours, and, in addition, the signal level output from the monoscope is relatively low and changes as the monoscope ages.

SUMMARY OF THE INVENTION

This invention provides for an improved monoscope or light sensitive tube display system using a target comprising semiconductor material. In the monoscope, the target comprises a wafer having a first layer of, for example, silicon, germanium or any other suitable semiconductor material, coated on one side with a conducting layer of metal, such as gold and attached to a base support plate. The other side of the wafer has a layer of low resistivity semiconductor material of the opposite conductivity type from said first layer and is covered by a mask which, at the velocity of the electron beam, is substantially impervious to electron bombardment, and may be of any desired material such as a metal, semiconductor or insulator or combinations thereof. Apertures through the mask expose the semiconductor material, and the shape of the apertures is such that a beam scanning across the apertures will produce an output signal for presentation on a cathode ray tube of the desired character. A back bias is applied to the junction by an external voltage source in series with a load impedance across which the signal output is generated.

Preferably, the target is made of a layer of N type silicon on the order of 10 mils thick having a realtively high resistance such as $10^{13}$ charge carriers per cubic centimeter. One side is coated with a metal conductor and the other side has diffused into it a thin layer of P type impurity, in sufficient concentration to produce a high conductivity P layer, such as for example, $10^{19}$ carriers per cubic centimeter. The P layer is, for example, less than one micron thick. The high impurity concentration in the P layer causes the P layer to act substantially as a conductor so that an additional conductive coating over the P layer is not required but may be used if desired. Rather, a contact made with the P layer and the external circuitry at one point will produce good contact with the entire useful surface of the target. The mask when made, for example, of silicon dioxide is of sufficient thickness, for example, several microns, that the electron beam will not penetrate into the semiconductor body to the region of the junction.

A substantial back bias voltage is applied across the junction in series with an external load so that when the electron beam impinges on the semiconductor, it will penetrate into the junction region where a substantial voltage gradient is produced by the back bias. Electron-hole pairs are generated in proportion to the electron velocity as determined by its accelerating voltage divided by the theoretical voltage required to generate one electron-hole pair. In the case of a silicon target, this is approximately 3.6 volts, and therefore when an electron beam accelerated, for example, by 3600 volts strikes the target an output signal is produced which is approximately 1000 times the beam current. Because of the high output signal possible by relatively high beam voltages, beam current may be reduced, thereby improving definition and permitting reduction of the size of the target. This in turn reduces the output capacitance produced primarily by the target junction region thereby increasing the possible frequency response. A video frequency response extending from substantially 0 to over 100 megahertz is practicable in a display system using such a monoscope.

In a further embodiment of the invention, the semiconductor junction target is positioned on or adjacent to the gun structure and the main target structure is made separate therefrom. The main target structure produces a return stream of electrons modulated with information on the main target structure. The main target structure is, for example, a photoconductive target comprising for example, a layer of antimony trisulfide which is charged by the electron beam and areas of which are discharged by the impingement of a light pattern thereon. The discharged portions of the target accept recharging electrons when scanned by the beam whereas those portions which are not discharged reflect electrons from the beam which strike the junction target. The velocity at which the electrons strike the junction is approximately that produced by cathode to anode potential, and may be, for example, 500 to 5000 volts. The resulting current multiplication produces an output signal across an external load impedance connected in series with an external back bias voltage source across the junction.

The invention provides for an improved display system in which any tube, such as a monoscope, light sensitive tube, informational storage tube, or other tube which can be made to produce an informational signal generated by deflection of an electron beam and by charge carrier multiplication in the tube, supplies an information signal output to a display device such as a cathode ray tube intensity modulated by said informational signal.

Figure 2:
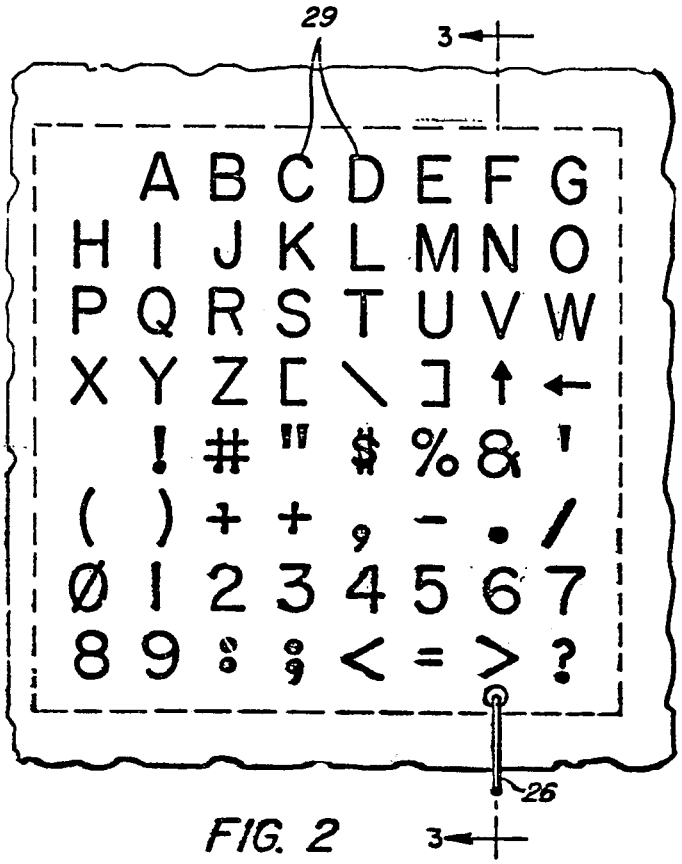
Figure 3:
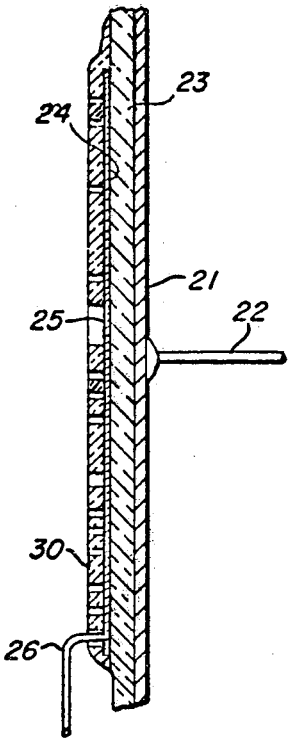
Figure 4:
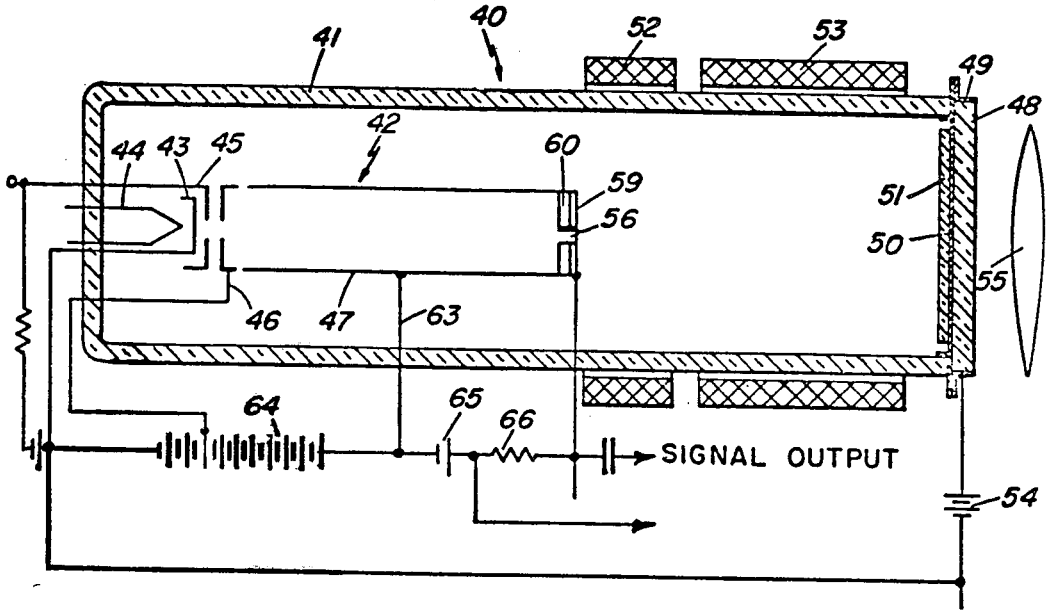
Figure 5:
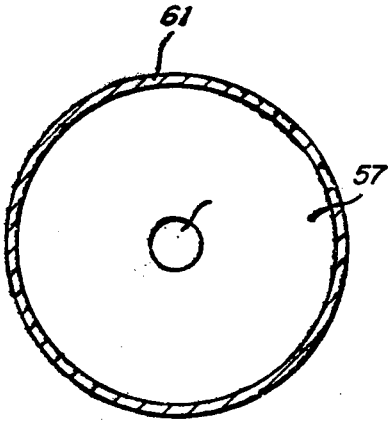
Figure 6:
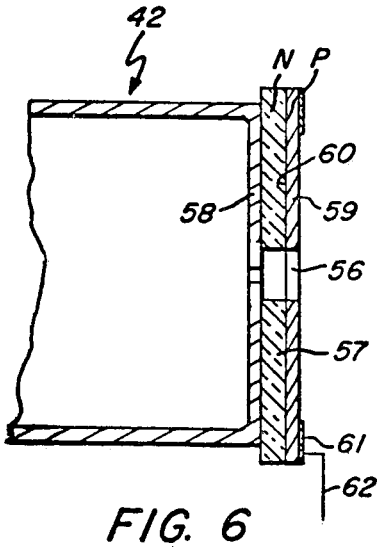

Further details and advantages of the invention will be apparent as the description thereof progresses reference being had to the accompanying drawings wherein:

FIG. 1 illustrates a transverse cross-sectional view of a monoscope embodying the invention, FIG. 2 illustrates a portion of the target electrode structure of the monoscope illustrated in FIG. 1, FIG. 3 is a transverse cross-sectional of the portion of the target structure illustrated in FIG. 2, FIG. 4 is a transverse cross-sectional view of a camera tube embodying a further feature of the invention, FIG. 5 illustrates an elevation view from the end of a gun structure, such as that shown in FIG. 4, and FIG. 6 is a transverse cross-sectional view of the gun structure shown in FIG. 5.

Figure 7:
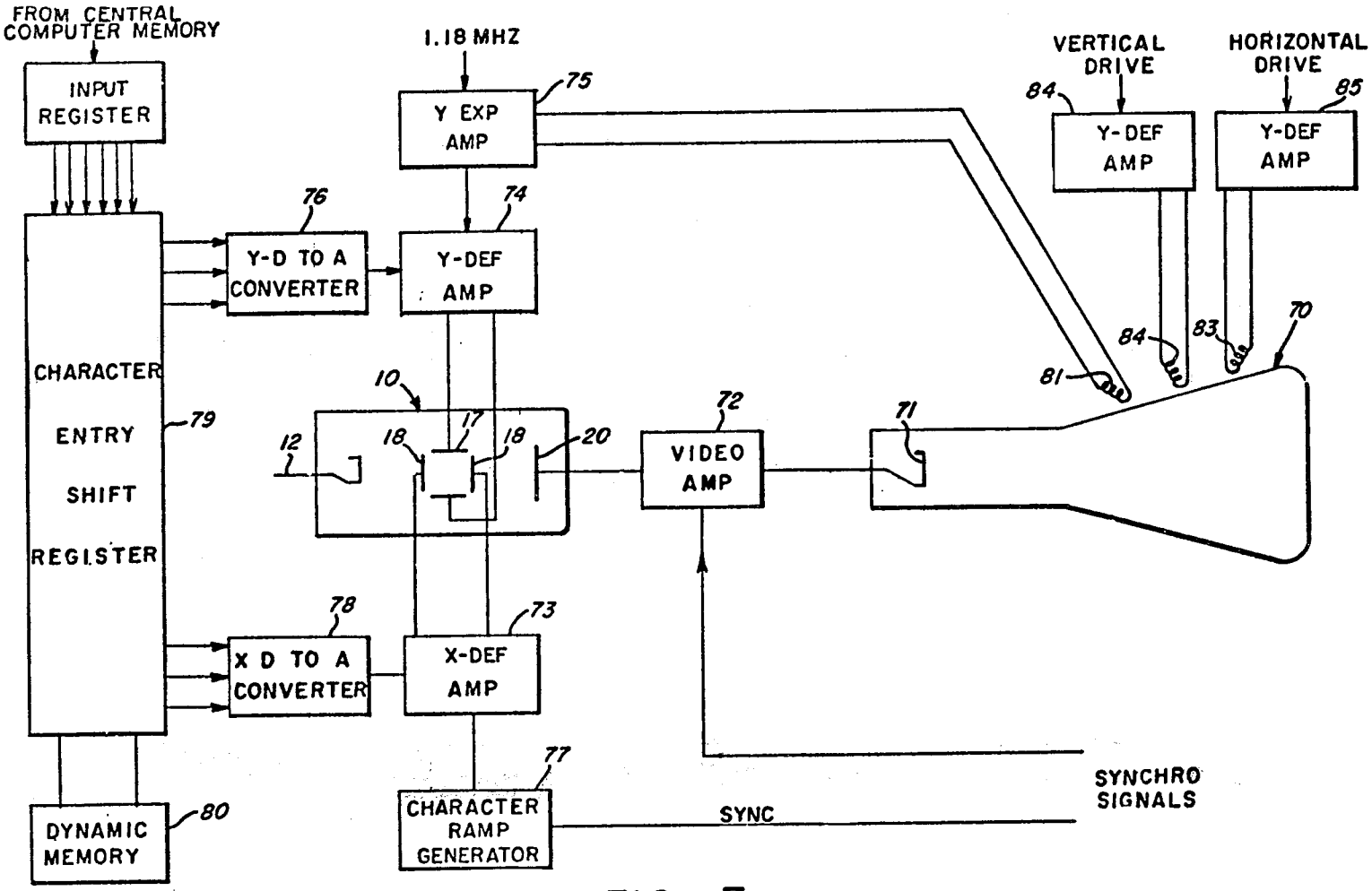

FIG. 7 illustrates a data information display system embodying the invention.

Referring now to FIG. 1 there is shown a monoscope tube 10 comprising an envelope 11. A cathode 12 heated by a heater 13, a control grid 14, accellerating anode structure 15, focusing electrode 16, vertical deflection plates 17, and horizontal deflection plates 18 are all mounted inside the envelope 11 in a gun assembly of well known construction used in conventional monoscopes. The raster scan 19 feeds deflection voltages to the plates 17 and 18 to position the electron beam on particular positions on a target structure 20.

An electrode structure 20, shown in greater detail in FIGS. 2 and 3, is supported by a metal backing plate 21 on a rod 22 extending through the envelope 11. Attached to plate 21 is a layer of silicon semiconductor material 23 preferably of N impurity type and having a relatively high resistance. For example, layer 23 may be approximately 10 mils thick and have an impurity of approximately $10^{13}$ atoms per cubic centimeter. A junction is formed at 24 in a well known manner by thermal diffusion of P impurity material into the layer 23 to form a relatively low resistance P type impurity layer 25. Layer 25 may be of any desired thickness, but is sufficiently thin that electrons from the beam will readily penetrate to the junction region and for silicon is preferably between 0.1 and 1 microns in thickness. The conductivity of the P layer 25 region is made very substantially greater than the conductivity of the N region 23 so that it will serve as a relatively low resistance conductor to all points of the layer 25. A lead in 26 is connected to the P type semiconductor material and lead 26 extends out to the envelope 11. A back bias is supplied across the junction formed by the portions 23 and 25 by means of a battery 27 applied between leads 26 and 22 through an output load impedance 28.

Characters 29 illustrated in FIG. 2 are formed on the face of the target 20 in the following manner. A silicon dioxide layer 30 is formed over the complete surface of the layers 25 and 23 by heating the target structure in an oxidizing atmosphere. A photoresist is applied over the silicon dioxide, the letters and other characters 29 are put onto the photoresist and the photoresist is developed in a well known manner to remove the portions of the photoresist defining the characters. The portions of layer 30 defining characters 29 are then etched away to expose the P layer portions. The layer 30 is made sufficiently thick, for example, 1 micron thick or less, that substantially no electrons from the beam will penetrate through layer 30. Since the layer 25 is formed by oxidizing the P layer, the P layer is first formed to a thickness somewhat greater than 1 micron and this thickness is reduced by oxidation to the final thickness.

When a suitable voltage of, for example, 500 to 5,000 volts is applied between the cathode 12 and the target electrode 20, electrons will strike the target with sufficient velocity to penetrate the P layer 25 of the target 20 when the electron beam passes over an exposed region of P material, but when the electron beam strikes the layer 30, electrons will not penetrate the P layer 25. The back bias supplied across the junction 24 by the battery 27 produces a voltage gradient in layer 25 extending substantially from junction 24 to the plate 21. As a result when beam electrons penetrate the semiconductor material to the region of junction 24, they produce electron-hole pairs substantially in direct proportion to their electron velocity. For example, a voltage of 3600 volts applied between the cathode 12 and the target 20 will produce approximately 1000 electron-hole pairs in the silicon semiconductor target 20. Because of the voltage gradient in layer 23 produced by battery 27, 1000 electrons would be moved to the positive side of the battery 27 and 1000 electrons would be pulled through the load resistor 28 to neutralize the positive charge carriers moving through layer 23 to the plate 21. Accordingly, a current gain of approximately 1000 times the beam current is produced by this target structure.

Because of this current gain the electron beam current can be much lower than present devices while still producing a sufficient output signal across the resistor 28 to drive an amplifier or even a cathode ray tube display device directly. By reducing the beam current, for example, to the order of 1 microampere or so, the spot size of the electron beam on the target 20 may be made much smaller than with previous monoscopes for the same signal output. As a result, smaller characters can be used while still maintaining the same definition. The net result of using smaller characters is that the total target size on which a given number of characters are positioned may be reduced, and this in turn results in a low interelectrode capacitance between plate 21 and the P layer 25 so that the upper frequency of the output signal in a display system using this monoscope can be much higher than in previous practical systems. For example, the target structure 20 in a practical device can have the portion thereof on which the characters are displayed approximately ⅜ inch across whereas normal monoscope targets structures are an inch or two in diameter.

Alternatively, a larger number of characters may be positioned on a given size of target.

A target area reduction of 4 or 5 to 1 produces a corresponding reduction in interelectrode capacitance, and a high signal current output permits use of a lower load resistance 28 than present systems for the same signal output power. Since the product of the output load resistance and the target interelectrode capacitance varies as an inverse function of the practical upper frequency response limit of the system, reducing this product increases the maximum frequency output. The upper frequency response of the target 20 is also limited by the transit time of a charge carrier through the semiconductor layer 23. The resistance 28 may be reduced if the cathode to anode voltage is increased such that a higher signal current is produced through the resistor 28 due to a higher current multiplication in the target 20. The capacitance may be reduced by making the thickness of the semiconductor wafer 23 greater. However, this increases transit time and therefore a point is reached at which, for practical values of the back-bias voltage produced by battery 27, an upper frequency limit is defined. For example, with a bias voltage of from 100 to 300 volts and a thickness of layer 23 of 10 mils, a transit time permitting operation of frequencies in excess of 100 megacycles is possible.

Referring now to FIG. 4, there is shown a further embodiment of the invention wherein a light sensitive tube generally of the vidicon type is illustrated at 40. Tube 40 comprises a glass envelope 41 and an electrode gun assembly 42 comprising a cathode 43, a heater 44, a control grid 45, and a focusing and accellerating anode structure comprising tubular portions 46 and 47. Envelope 41 has a flat glass faceplate 48 at-